United States Patent [19]

Bergler

[11] Patent Number: 4,612,999

[45] Date of Patent: Sep. 23, 1986

[54] PERCUSSION TOOL

[75] Inventor: Otto Bergler, Mühlacker-Lomersheim, Fed. Rep. of Germany

[73] Assignee: Black & Decker Overseas AG, Vaduz, Liechtenstein

[21] Appl. No.: 622,271

[22] Filed: Jun. 19, 1984

[30] Foreign Application Priority Data

Jun. 25, 1983 [DE] Fed. Rep. of Germany ..... 3322964

[51] Int. Cl.[4] ..... B25D 16/00

[52] U.S. Cl. ..... 173/109; 173/48; 173/123; 74/22 A; 74/60

[58] Field of Search ..... 74/22 A, 60; 173/48, 173/13, 14, 18, 47, 104, 109, 110, 111, 116, 128, 131, 123, 139; 144/35 A

[56] References Cited

U.S. PATENT DOCUMENTS

| | | | |
|---|---|---|---|
| 1,901,981 | 3/1933 | Ousbach | 173/139 X |
| 2,024,684 | 12/1935 | Erfass | 173/139 X |
| 2,491,624 | 12/1949 | Shaff | 74/60 |
| 2,601,788 | 7/1952 | Parker | 74/22 A X |
| 4,280,359 | 7/1981 | Schmidt et al. | 74/60 |
| 4,284,148 | 8/1981 | Wanner et al. | 173/109 |
| 4,446,931 | 5/1984 | Bleicher et al. | 173/48 |

FOREIGN PATENT DOCUMENTS

| | | |
|---|---|---|
| 3106487 | 9/1982 | Fed. Rep. of Germany . |
| 3241528 | 5/1984 | Fed. Rep. of Germany . |
| 563845 | 7/1975 | Switzerland . |
| 588632 | 6/1977 | Switzerland . |

*Primary Examiner*—Donald R. Schran
*Assistant Examiner*—James L. Wolfe
*Attorney, Agent, or Firm*—Burns, Doane, Swecker & Mathis

[57] ABSTRACT

A percussion tool such as a hammer head comprises a housing for receiving a tool. A rotary drive mechanism rotates the tool about a longitudinal axis. A strike bolt is arranged for impacting against the tool. A cylinder sleeve is mounted coaxially with the longitudinal axis. A piston is slidable within the sleeve and is arranged to impact against the strike bolt. An impact drive mechanism is provided for imparting sliding movement to the piston toward the strike bolt. The impact drive mechanism comprises a wobble drive member mounted for longitudinal reciprocal movement and for rotary movement about an inclined axis disposed at an acute angle relative to the longitudinal axis. The wobble drive member is operably connected to the cylinder sleeve and to the rotary drive means to be driven thereby about the inclined axis so as to be longitudinally reciprocated. Thus, the rotary forces and impacting forces are derived from the same source.

8 Claims, 6 Drawing Figures

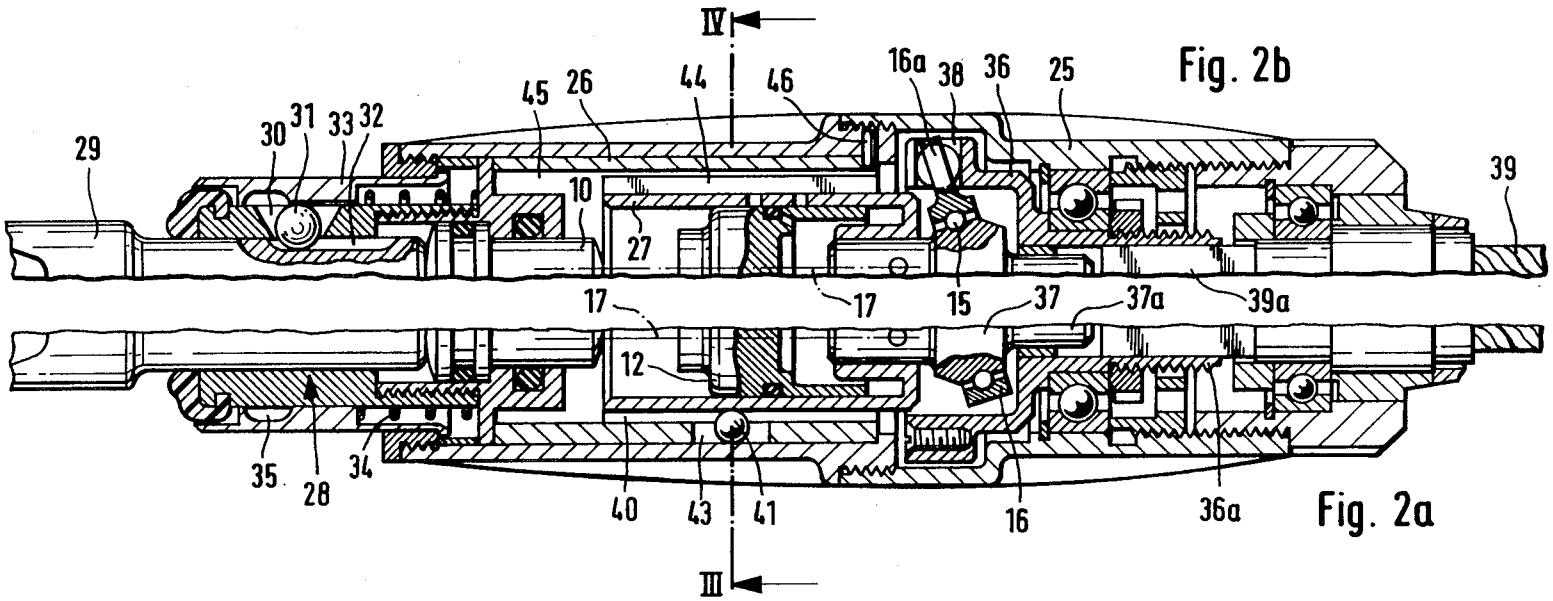
Fig. 2b
Fig. 2a
39
39a
36a
37a
37
25
36
38
16a
15
16
17
46
IV
III
41
44
43
27
12
40
26
10
45
32
33
31
30
34
28
35
29
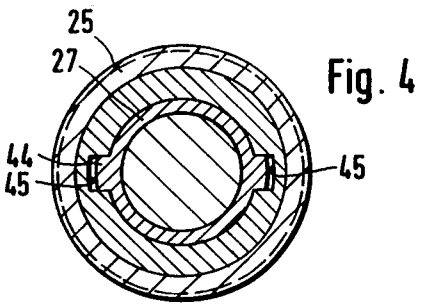
Fig. 4
45
25
27
44
45
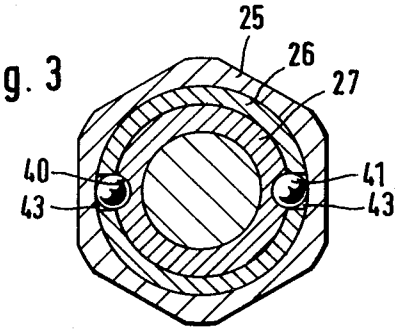
Fig. 3
41
43
27
26
25
40
43

PERCUSSION TOOL

BACKGROUND AND OBJECTS OF THE INVENTION

The invention concerns a percussion tool, in particular a hammer drill, wherein the percussion effect on the tool is provided by a striking bolt actively connected with a piston for acting on the end of the tool; the piston is guided in a cylinder sleeve arranged coaxially with a rotating drive, wherein a pressure actuating the movement of the piston is generated in front of the piston by a reciprocating motion.

Hammer drills of this type are known (e.g., see Hilti Operating Instructions for Hammer Drill TE12, W 1030 1081 40-s, printed in Liechtenstein, 1981). In the known configurations, an additional piston is guided back and forth in a cylinder sleeve by means of a connecting rod drive, which additional piston creates the impact motion of the piston connected with the striking bolt. The cylinder sleeve is supported in a hollow drive spindle whereby the rotating motion necessary for the drilling is transmitted to the tool. A disadvantage of these configurations is that because of the need to drive both the drive spindle for the drilling tool and the strike piston, two different driving devices are needed. These devices, especially the drive to generate impact motion, requires much space, so that the housing to contain such a layout must be relatively large and heavy. This is true also for designs (e.g., see Offenlegungsschrift DE No. 32 41 528 A1, corresponding to pending U.S. patent application Ser. No. 06/548,764 filed Nov. 4, 1983 by the applicant of record) already proposed, wherein the cylinder sleeve guiding the piston is itself moved back and forth. Here again, an additional drive must be placed into the housing, the arrangement and dimensions whereof necessarily lead to a relatively voluminous structure.

It is an object of the present invention to minimize the above problems by providing solutions permitting a space saving layout of the drive to produce the reciprocating motion in percussion tools such as hammer drills.

SUMMARY OF THE INVENTION

The invention involves a drive for creating the reciprocating motion being in the form of a wobble drive, the rotating axis of which coincides with the longitudinal axis of the rotating drive. This configuration makes it possible to eliminate in hammer drills of the afore-mentioned type the additional drive mechanism provided outside the axis of the drive spindle. The result is a layout aligned with respect to one axis only, which saves an appreciable amount of space.

It is advantageous to have the wobble drive comprise a guide piece, arranged in a housing in an axially displaceable manner and secured against rotation. A wobble member is rotatably supported on a guide groove for rotation about an axis which is inclined relative to the longitudinal axis. A wobble arm of the wobble member is connected to a spindle forming the rotating drive. This configuration yields the advantage that it is applicable not only to hammer drills of the known type, as explained hereinbelow, but that the spindle may further be designed as bell-shaped and supported in the housing and driven by means of a flexible shaft. This configuration leads to a cutting tool used exclusively for percussion purposes, that may be in the form of a cylinder with a relatively small diameter and which may, therefore, be handled in a particularly simple manner. In such a configuration of a mortiser, the guide piece may be connected by simple means with the cylinder sleeve guided fixedly in rotation in a housing, while the cylinder sleeve may be displaceable in a simple manner in a guide sleeve, which, in turn, is seated fixedly in the housing and is cooperating by means of a positive axial lock with the cylinder sleeve. This positive lock may be effected in a manner known in itself by a multipart section or axial grooves with balls in between or by axial ribs engaging the corresponding grooves of the other part.

The invention may also be used to obtain significant space and structural savings in hammer drills with a drive spindle. Thus, particularly in hammer drills in which the cylinder sleeve is moved back and forth by the drive, the sleeve forming the rotating drive for the wobble drive may be part of a hollow drive spindle for a percussion drilling tool, in which the cylinder sleeve is also located in a displaceable manner. In this embodiment, an axially equal arrangement of the drive for the impact process is obtained. It is appropriate here to support the guide piece axially on a guide bolt arranged coaxially with the axle of the drive spindle, wherein the guide bolt may be seated fixedly in the housing and the guide piece is moved either secured against rotation or rotatingly on the guide bolt, depending on the setting of a control circuit, so that the hammer drill may be switched either to percussion drilling or to drilling alone. The control circuit may be effected in different manners. For example, it is conceivable to make the guide bolt hollow and to actuate through this hollow guide bolt an expanding mechanism operated by an axially displaceable connecting rod in the hollow guide bolt, leading to a solid or loose connection between the guide piece and the guide bolt. It would further be possible to connect the guide bolt fixedly in rotation with the guide piece, while arranging it, depending on the setting of the control circuit, rotatingly or stationarily in the housing, which may be obtained for example by means of a clamping device actuated from the outside for the guide bolt.

THE DRAWING

The objects and advantages of the invention will become apparent from the following detailed description of preferred embodiments thereof in connection with the accompanying drawings in which like numerals designate like elements, and in which:

FIG. 1 shows a schematic partial longitudinal section through a hammer drill, with a configuration according to the invention;

FIGS. 2*a* and 2*b* depict, respectively, portions of a longitudinal section through a mortising tool, wherein in each figure, a different way of fixing a cylinder sleeve against rotation is shown;

FIG. 3 is a cross-section through the portion of the tool according to FIG. 2*a*, depicting the rotation-preventing means thereof;

FIG. 4 is a cross-section through the portion of the tool according to FIG. 2*b* depicting the rotation-preventing means thereof.

DETAILED DESCRIPTION OF PREFERRED EMBODIMENTS OF THE INVENTION

Figure 1:
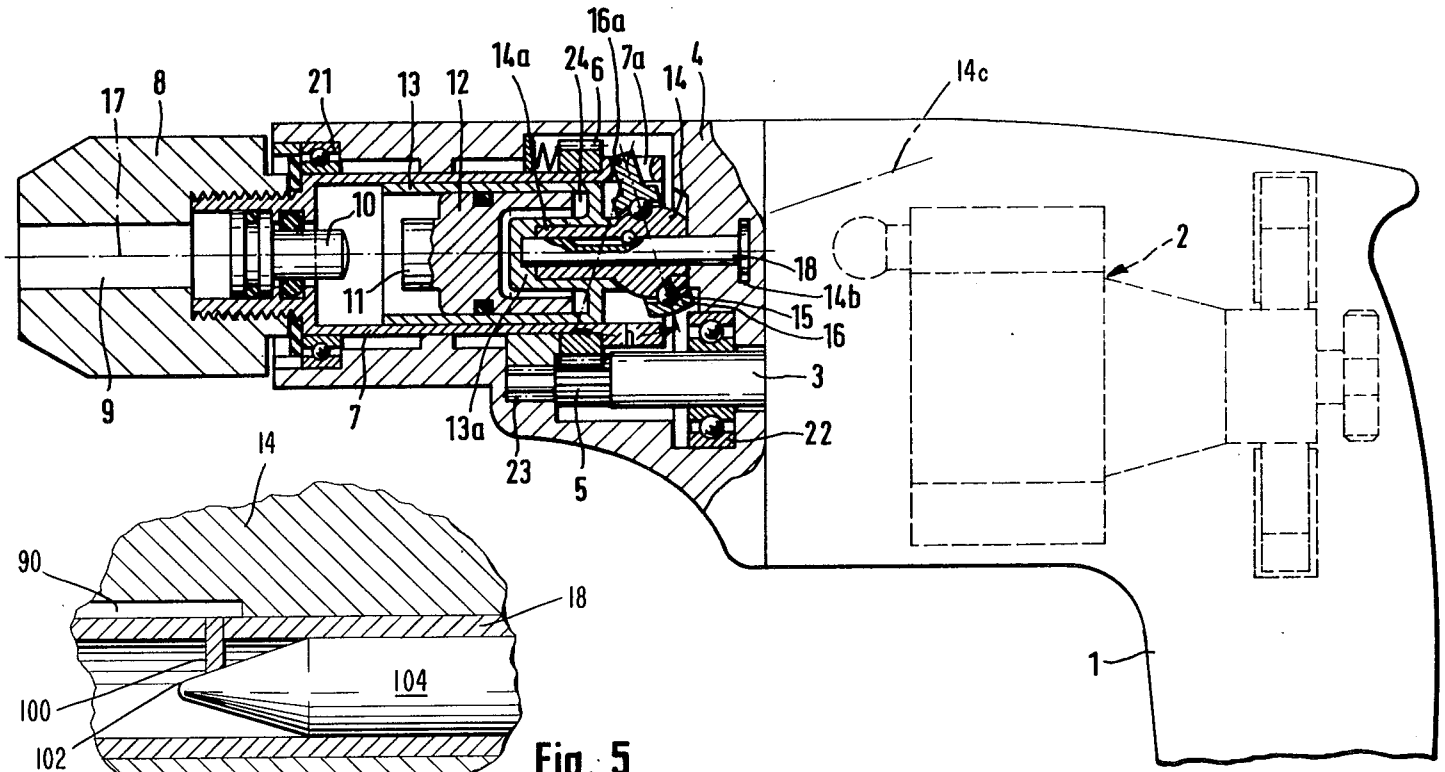

FIG. 1 shows schematically a hammer drill equipped with a manual handle 1 in a known manner and provided with an electric motor drive 2 inside a handle housing. A drive shaft 3 leads from the motor to the parts to be driven. The drive shaft 3, supported in a known manner in the housing 4 of the hammer drill, carries a pinion 5 which engages a toothed wheel 6. The latter is fixedly connected to a hollow drive sleeve or spindle which is rotatably supported in the housing 4. A boring head 8 is screwed (in a manner not shown in detail) onto the outer end (i.e., left end in FIG. 1) of the drive spindle and serves to mount a percussion drilling tool to be inserted in a bore 9. The drive spindle 7 is thus rotated by the drive shaft 3 and the toothed wheel 6, and transmits this rotation to drive a drilling tool (not shown) through the boring head 8.

Figure 5:
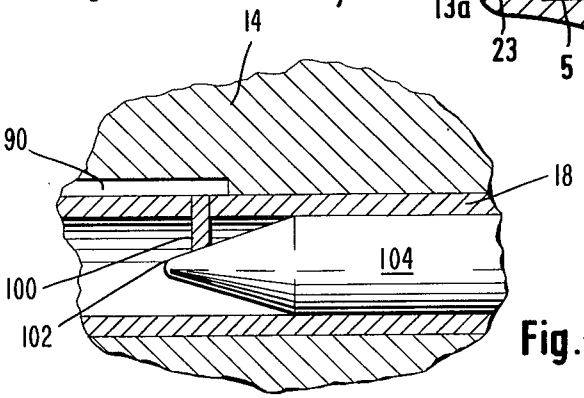
FIG. 5 is a fragmentary, longitudinal sectional view depicting an alternative structure for preventing rotation of a guide piece.

In order to be able to impart an impact effect to the end of the percussion drilling tool, a bolt striking bolt 10 is guided for reciprocation in the drive spindle 7. An outer piston-like end of the bolt 10 (at the left end in FIG. 1) is adapted to abut against an inserted tool. A rear striking bolt 11 is adapted to act on the inner right-hand end of the front striking bolt 10. The bolt 11 is fixedly connected to a piston 12, which, in turn, is guided in an axially displaceable manner in a cylinder sleeve 13, the latter being guided in a cylindrical guide bore within the drive spindle 7. The cylinder sleeve 13 has, at its inner (right-hand) end, a flange-like bottom with a hub 13*a*, into which a projection 14*a* of a guide piece 14 is fixedly inserted. The guide piece 14 includes, adjacent to the cylindrical part 14*a*, a spherical part upon which is arranged a circumferential guide rail or groove 14*b* having a semi-spherical cross-section. Disposed in the groove 14*b* are a series of bearing balls 15 which movably support a ring 16 having an upwardly projecting wobble arm 16*a*. The guide groove 14*b* defines an inclined axis 14*c* oriented at an acute angle with respect to the axis 17 and to a plane arranged perpendicularly to the axis 17, i.e., to the rotary axis 17 of the drive spindle 4. The axis 17 coincides with the axis of the piston 12, the cylinder sleeve 13, and the guide piece 14. The guide piece 14 is arranged in an axially displaceable manner on a non-rotary guide bolt 18, which also is aligned coaxially with respect to the axis 17. At least one groove 90 is provided in the guide piece 14 (FIG. 5) to be engaged by a driver supported in a radially displaceable manner in the guide bolt 18 and immobilized in its radial position by a longitudinally movable conical camming part 102. The camming part is arranged at the end of an actuating rod which extends axially through the non-rotary hollow guide bolt 18 and is adjustable longitudinally relative to the bolt 18 and the driver. The camming part can cam the driver radially outwardly into the groove 90 to prevent rotation of the guide piece 14.

The wobble arm 16*a* of the ring 16 is disposed loosely in a recess 7*a* of the drive spindle 7, which forms a drive sleeve for the wobble arm 16*a*. It should be mentioned for the sake of completeness that the drive spindle 7 is rotatably supported in the housing 4 in a conventional manner by means of ball bearings 21 or the like. Thus, the spindle 7 serves to guide the various components which are displaceably mounted thereon. The drive shaft 3 is supported in the housing 4 by means of ball bearings 22 and a slide bearing 23.

OPERATION of the hammer drill is as follows:

For a "percussion" mode of the drill, assume initially that the drive motor 2 is rotating the drive spindle 7 by means of the shaft 3. By this rotating motion the tool (not shown) may be caused to rotate. On the other hand, the rotating motion of the drive spindle 7 also causes the wobble arm 16*a* to rotate. Since the ring 16 is constrained to follow the balls 15 which are mounted in the non-rotating, oblique groove 14*b*, the wobble arm 16*a* rotates about the inclined axis 14*c* and eventually contacts a rear (right-hand) fact of the recess 7*a* and is displaced longitudinally outwardly thereby (i.e., to the left in FIG. 1) and carries with it the guide piece 14. Thus, the guide piece 14 is urged by the balls 15 acting against the recess 14*b* to move longitudinally to the left upon the bolt 18 by a stroke length h. Continued rotation of the spindle 7 produces reciprocation of the guide piece 14 along the stroke length h. The cylindrical sleeve 13 is thus also caused to reciprocate along the stroke length h. A fluid medium, generally air, present in the space 24 between the piston 12 and the bottom of the cylinder sleeve 13 is thereby periodically compressed, and the piston 12 is thus thrown periodically by the pressure effects in the space 24 against the strike bolt 10. The strike bolt 10, in turn, applies the desired percussion effect to the end of the tool, e.g., a hammer drill (not shown). In lieu of transmitting reciprocal forces to the piston 12 by means of compressed air, the sleeve 13 and/or the guide piece 14 for example, could be physically attached to the piston in any suitable way to reciprocate same.

If it is desired to switch to a "drilling" mode, the actuating rod is retracted axially to cause the driver to retract radially out of the groove 90. Thus, the ring 16 and its wobble arm 16*a* are free to rotate, whereby the spindle 7 no longer produces longitudinal displacement thereof. Consequently, the rotating drive spindle 7 entrains by means of the wobble arm 16*a* both the guide piece 14 and the bolt 18 in rotation. There is no longitudinal displacement of the guide piece 14 or the cylinder sleeve 13. Hence, no percussion occurs.

In addition to applying the FIG. 1 embodiment to a hammer drill, it is feasible to use that mechanism in a so-called mortizer, as shown in FIGS. 2*a* and 2*b*. There, a guide sleeve 26 is set fixedly against rotation in an approximately cylindrical housing 25, wherein a cylinder sleeve 27 is being guided in a non-rotating but axially displaceable manner, as depicted in detail in FIGS. 3 and 4. The sleeve 27 serves to guide the piston 12 which corresponds to the configuration of FIG. 1. In this embodiment, a guide head 28 is connected with the housing 25 and carries a chisel 29, the latter being held in an axially displaceable fashion. No rotating motion may be imparted to the chisel 19 in this form of embodiment. The chisel 29 is impacted by forces from the piston 12 through the strike bolt 10. Mortizing work may thus be performed. The guide head 28 is equipped with a ball 31 radially adjustable in a guide 30. The ball engages an axial groove 32 of the chisel. If the chisel is to be removed, a sleeve 33 is displaced to the right against the action of a spring 34, until an annular groove 35 of the sleeve arrives in the range of the ball 31, which then may be pressed radially outwardly, if the chisel 29 is being removed.

To obtain reciprocating motion of the piston 12, a bell-shaped sleeve 36 is connected for rotation with the end of a flexible drive shaft or cable 39, 39*a*. The sleeve or spindle 36 performs the same function as the drive spindle 7 of the embodiment of FIG. 1. A guide piece 37, essentially corresponding to the guide piece 14 of FIG. 1, here again is equipped with balls 15 revolving in a guide or groove rail. The balls guide the ring 16 with the wobble arm 16*a*. The wobble arm 16*a* is held in a movable (loose) manner in a recess 38 of the sleeve 36. The guide piece 37 is connected fixedly (see FIG. 1) with the cylinder sleeve 27, which as mentioned hereinabove, is guided fixedly against rotation in the housing 25. The guiding piece 37 has a journal 37*a* seated rotatingly in the sleeve 36, within the range of the part 36*a*, in which the end of the flexible shaft 39 is also held. The end 39*a* of the flexible shaft 39 may be a square inserted in a corresponding recess of the part 36*a* of the sleeve 36.

As seen in FIGS. 3 and 4, there are various possible ways to guide the cylinder sleeve 37 for non-rotary longitudinal travel in the sleeve 26 and in the housing 25. FIGS. 2*a* and 3 demonstrate the possibility of equipping the cylinder sleeve 37 with axial grooves 40, in which balls 41 are moving, to in turn engage the slot 43 having the length of the stroke of the cylinder sleeve 27. FIGS. 4 and 2 show that it is possible to equip the cylinder sleeve 27 with diametrically opposing ribs 44, engaging the axial grooves 45 of the guide sleeve 26. The guide sleeve 26 is pressed into the housing 25 as shown in FIGS. 2*a* and 2*b*. It may further be secured by the retaining pins 46.

Although the present invention has been described in connection with preferred embodiments thereof, it will be appreciated by those skilled in the art that additions, modifications, substitutions, and deletions may be made without departing from the spirit and scope of the invention as defined in the appended claims.

What is claimed is:

1. A percussion tool comprising:

a housing having a front end for receiving a tool, a motor mounted in said housing, a strike bolt aligned longitudinally with said tool and being reciprocable in a longitudinal direction behind said tool for impacting thereagainst, a piston aligned longitudinally with said strike bolt and being longitudinally reciprocable behind said strike bolt for impacting thereagainst, impact drive means for imparting reciprocable movement to said piston toward said strike bolt, comprising guide means aligned longitudinally with said piston and mounted for longitudinal reciprocation, said guide means being operably connected to said piston to reciprocate said piston when said guide means is reciprocated, a wobble member mounted on an outer periphery of said guide means for rotation about an inclined axis disposed at an acute angle relative to said longitudinal direction, a drive member rotatably driven by said motor about a longitudinal axis aligned with said guide means and being coupled to said wobble member to rotate the latter about said inclined axis, and means preventing rotation of said guide means so that rotation of said wobble member about said inclined axis produces longitudinal reciprocation of said guide means and said piston.

2. A tool according to claim 1, wherein said wobble member includes an arm extending outwardly in a direction which is radial with respect to said inclined axis, said arm being received in a recess of said drive member to be driven by the latter.

3. A tool according to claim 1 including a cylinder sleeve carried by said guide means, said piston being coaxially mounted in said cylinder sleeve, and a fluid medium contained in a space longitudinally separating said guide means and said piston, said fluid medium being compressed in response to forward longitudinal movement of said guide means in order to move said piston longitudinally forwardly.

4. A tool according to claim 1, wherein said drive member comprises sleeve means including a front portion with coupling means for rotating the tool and a rear portion coaxial with said front portion and connected to said wobble member to rotate the latter simultaneously with the tool.

5. A tool according to claim 4, wherein said guide means and piston are longitudinally reciprocable within said sleeve means.

6. A tool according to claim 4, wherein said guide means is mounted for rotation about a longitudinal axis defined by the longitudinal axis of said drive member, said means preventing rotation of said guide means being selectively releasable to permit such rotation so that rotation of said wobble member produces rotation of said guide means without reciprocation thereof.

7. A tool according to claim 6 including a drive shaft driven by said motor and extending parallel to said longitudinal axis, a pinion carried by said drive shaft and drivably connected to said sleeve means.

8. A tool according to claim 1 including a drive shaft connected between said motor and said drive member, an end of said drive shaft connected to said drive member being longitudinally aligned with said guide means.

* * * * *